US005775649A

United States Patent [19]

O'Leary

[11] Patent Number: 5,775,649

[45] Date of Patent: Jul. 7, 1998

[54] BAG HOLDER

[76] Inventor: Dennis S. O'Leary, 3712 Misty Oak Dr., Memphis, Tenn. 38125

[21] Appl. No.: 821,469

[22] Filed: Mar. 21, 1997

Related U.S. Application Data

[63] Continuation-in-part of Ser. No. 655,976, May 31, 1996, abandoned.

[51] Int. Cl.[6] ..... A63B 55/04

[52] U.S. Cl. ..... 248/97; 248/99; 248/100; 141/391

[58] Field of Search ..... 248/97, 99, 100; 21/12; 141/391

[56] References Cited

U.S. PATENT DOCUMENTS

| | | | |
|---|---|---|---|
| 4,708,307 | 11/1987 | Daigle | 248/97 |
| 5,048,778 | 9/1991 | Wright | 248/98 |
| 5,169,101 | 12/1992 | Wenzel et al. | 248/97 |
| 5,213,291 | 5/1993 | Weibe | 248/97 |
| 5,570,862 | 11/1996 | Nugent | 248/97 |

*Primary Examiner*—Carl Friedman

*Assistant Examiner*—W. Glenn Edwards

*Attorney, Agent, or Firm*—Walker, McKenzie & Walker, P.C.

[57] ABSTRACT

A free-standing, one-piece bag holder made up of a resilient rolled metal. The base of the bag holder consists of two parallel base members of the rolled metal. A crossbar that is perpendicular to the base members is fixedly attached at the ends thereof to the respective base members at points on the base members which are midway between the ends of the base members. Portions of the base members extend upwardly at an angle from the opposite ends of the base members towards the mid-portions of the base members. Four legs respectively extend upwardly at right angles relative to the portions of the base members so that the sides of the bag holder diverge outwardly from one another when the bag holder is in a bag removed condition. When the bag holder is in a bag holding condition the bag pulls the sides of the bag holder inwardly which moves the portions of the base members towards a substantially straight disposition which substantially flattens the bottom of the base of the bag holder to stabilize the bag holder. The combined spring action of the legs and the portions of the base members holds a bag taut and secure when stretched over lips of the bag holder.

5 Claims, 3 Drawing Sheets

BAG HOLDER

CROSS REFERENCE TO RELATED APPLICATIONS

This application is a continuation-in-part of application Ser. No. 08/655,976, filed May 31, 1996, entitled "Bag Holder", now pending.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

The present invention relates, in general, to free-standing bag holders which hold plastic bags suspended and open at the mouth.

2. Information Disclosure Statement

It is often desired to have a bag holder which is simple in construction, which securely holds different sizes of bags, which is stable and does not rock when placed on a supporting surface, which is easily moved while being utilized, and which has means for providing a strong spring action to spread the mouth of different sizes of bags. There have been many prior bag holders in the prior art but none to applicant's knowledge accomplish the above overall combination of purposes.

Applicant has knowledge of the following patents some of which may be relevant to the present invention, but none of these references, either singly or in combination, disclose or suggest the present invention.:

Wright, U.S. Pat. No. 5,048,778, issued Sep. 17, 1991, discloses a complex bag holder which holds the bag open and is free-standing. It has support means that can be moved between an in-use position and a stored position, and has a funnel for funneling trash into the bag. The bag holder of Wright is limited to the size bags that it can accommodate.

Wenzel et al, U.S. Pat. No. 5,169,101, issued Dec. 8, 1992 discloses a complex rack for supporting flexible bags in an open condition for collecting recyclable materials. The device disclosed in Wenzel et al has four foot members from which four wire members respectively extend upwardly and at the upper ends thereof is attached a pair of outwardly extending rims. An upper base member and a lower base member define an opening which is effective to receive side retaining members that are assembled onto the base. There are a pair of rigidifying members extending angularly upward from their respective side retaining members to the respective four upstanding wire members.

Nugent, U.S. Pat. No. 5,570,862, issued Nov. 5, 1996, discloses a foldable refuse bag holder which stands upright by sinking the legs into the ground. On a hard surfaced floor the bag holder would not be sturdy or secure.

Weibe, U.S. Pat. No. 5,213,291, issued May 25, 1993, discloses a garbage bag holder for receiving the mouth of a garbage bag which is wrapped over the wire frame into an open position to receive garbage or other material. The bag holder is symmetrical so that it can be operated in an inverted position. There are straight bars which are connected at the opposite ends thereof to the legs at the opposite ends of the legs. The legs of the Weibe holder are bent relative to the bottom bars at an angle greater than 90 degrees relative to the bottom bars so that flexing of the legs are required during installation of a bag over the wire frame of the holder. However, if a bag with a small mouth were placed on the holder the straight bars at the bottom which support the holder may become bent downwardly and cause the holder to be unstable. Also, the Weibe holder has no cross members between the opposing sides of the holder to add rigidity to the holder and the holder may not lend enough support to fill industrial size bags full of debris or lawn clippings.

Daigle, U.S. Pat. No. 4,708,307, issued Nov. 24, 1987, discloses a stand for holding leaf bags. The stand is upright in configuration and maintains the bag in an open configuration. The stand also includes a fixed diameter outer ring member and a variable diameter inner ring member that cooperate with one another to hold the leaf bag in an upright position when being filled with leaves and to hold the mouth of the bag open as well.

BRIEF SUMMARY OF THE INVENTION

The present invention is an improved bag holder, which is economical to manufacture, which is simple in construction, is very effective in its ability to securely hold different sizes of bags, which is stable and does not rock when placed on a supporting surface, which is easily moved while being utilized, and which has means for providing a strong spring action to spread the mouth of different sizes of bags.

Therefore, several objects and advantages of the present invention are:

(a) to stretch open a bag for filling with objects.

(b) to stretch open the bag and allow it to be free-standing.

(c) the bag holder requires no straps or fasteners to keep the bag in place.

(d) the bag holder is easily moved while being utilized.

(e) made of simple, one piece construction.

(f) fits multi-sized bags.

Further objects and advantages of my invention will become apparent from a consideration of the drawings and ensuing description.

DETAILED DESCRIPTION OF THE INVENTION

Figure 1:
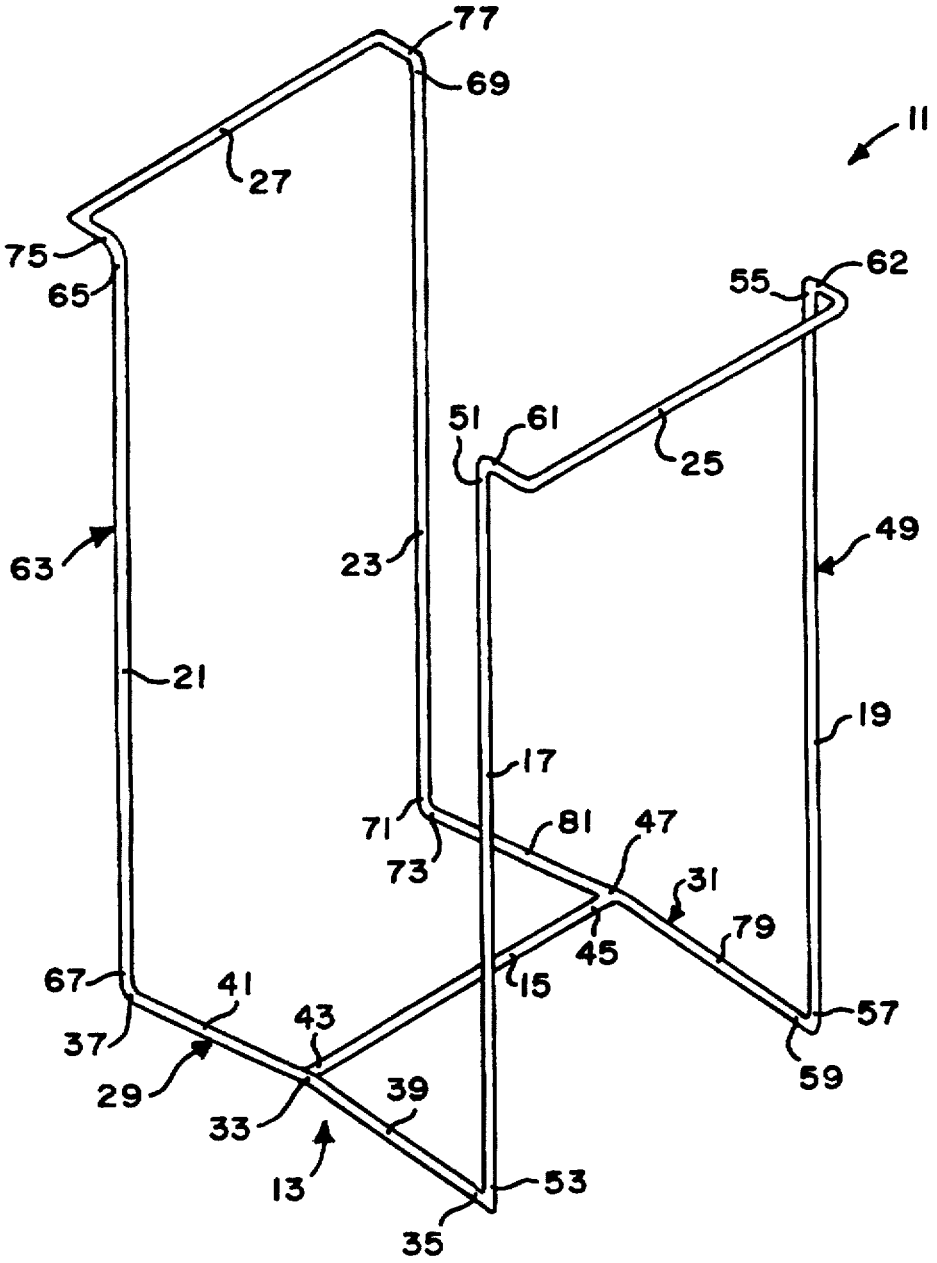
FIG. 1 is a perspective view of the bag holder of the present invention.
Figure 2:
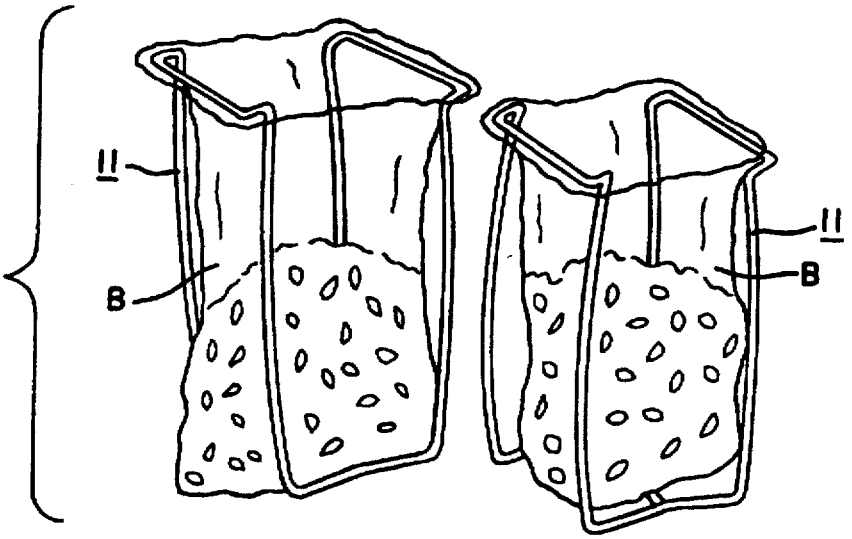
FIGS. 2 & 3 are perspective views showing the bag holder of the present invention in a bag holding condition and in use with various sizes of bags B and various weights of the contents of bags B.
Figure 3:
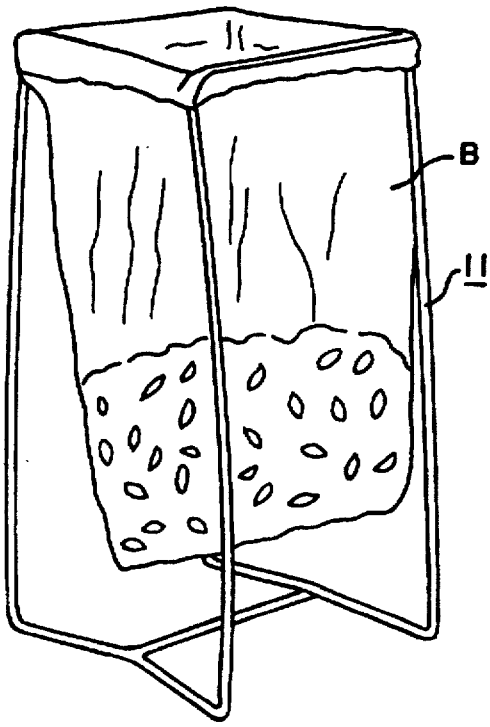
Figure 4:
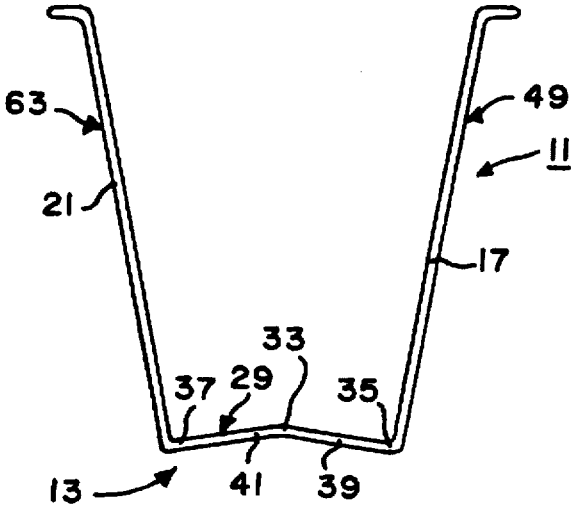
FIG. 4 is a end elevational view of the bag holder of the present invention shown in a bag removed condition.
Figure 5:
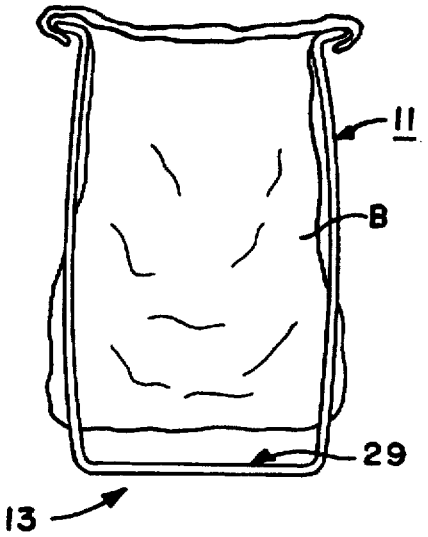
FIG. 5 is an end elevational view of the bag holder of the present invention shown in a bag holding condition.

Referring to FIGS. 1–5, the bag holder 11 of the present invention is of one integral piece and preferably constructed of resilient rolled steel. Bag holder 11 comprises, in general, a base 13 which sits on a supporting surface when bag holder 11 is in use, a single crossbar member 15, four resilient elongated leg members, namely, a first leg member 17, a second leg member 19, a third leg member 21 and a fourth leg member 23, a first lip portion 25, and a second lip portion 27.

More particularly, base 13 includes a first base member 29 and a second base member 31 which are spaced apart in substantially parallel relationship. First base member 29 includes a mid-portion 33, a first end 35, a second end 37, a first portion 39 extending between first end 35 and mid-portion 33, and a second portion 41 extending between second end 37 and mid-portion 33.

Crossbar member 15 extends between first base member 29 and second base member 31. Crossbar member 15 has a first end 43 and an opposite second end 45. Crossbar member 15 is fixedly attached at the first end 43 thereof to first base member 29 adjacent mid-portion 33 of first base member 29 and is fixedly attached at the second end 45 thereof to second base member 31 adjacent mid-portion 47 of second base member 31.

A first side 49 of bag holder 11 includes first leg member 17, which has an upper end 51 and a lower end 53, and second leg member 19 which has an upper end 55 and a lower end 57. First leg member 17 and second leg member 19 are spaced laterally apart from one another and are respectively fixedly attached adjacent the lower ends 53, 57 thereof to first end 35 of first base member 29 and first end 59 of second base member 31.

In addition, first side 49 of bag holder 11 includes first lip portion 25 which has a first end 61 and an opposite second end 62. First lip portion 25 is fixedly attached at the first and second ends 61, 62 thereof respectively to the upper ends 51, 55 of first leg member 17 and second leg member 19 and extend outwardly therefrom.

A second side 63 of bag holder 11 includes third leg member 21, which has an upper end 65 and a lower end 67, and fourth leg member 23 which has an upper end 69 and a lower end 71. Third leg member 21 and fourth leg member 23 are spaced laterally apart from one another and are respectively fixedly attached adjacent the lower ends 67, 71 thereof to second end 37 of first base member 29 and second end 73 of second base member 31.

In addition, second side 63 of bag holder 11 includes second lip portion 27 which has a first end 75 and an opposite second end 77. Second lip portion 25 is fixedly attached at the first and second ends 75, 77 thereof respectively to the upper ends 65, 69 of third leg member 21 and fourth leg member 23 and extend outwardly therefrom.

Bag holder 11 is selectively placeable in: (1) a bag holding condition shown in FIGS. 2, 3, and 5, in which a bag B is held by the bag holder 11 and (2) a bag removed condition shown in FIGS. 1 & 4, in which there is no bag being held by the bag holder 11. When bag holder 11 is in the bag removed condition first and second sides 49, 63 of bag holder 11 preferably diverge upwardly and outwardly away from one another with the upper ends thereof being spaced apart wider than the mouth of the bags to be held by bag holder 11. In addition, it should be understood that when bag holder 11 is in said bag removed condition, first and second portions 39, 41 of first base member 29 respectively extend upwardly at an angle from the first and second ends 35, 37 of first base member 29 towards mid-portion 33 of base member 29. Similarly, when bag holder 11 is in said bag removed condition, first and second portions 79, 81 of second base member 31 respectively extend upwardly at the same said angle from the first and second ends 59, 73 of second base member 31 towards mid-portion 47 of base member 31, as illustrated, for example, by the position of first base member 29 shown in FIG. 4, which would appear the same for second base member 31. Thus, when bag holder 11 is placed in said bag holding condition with a bag B on bag holder 11, first and second sides 49, 63 of bag holder 11 are held inwardly towards one another in a substantially vertical position or inwardly beyond a vertical position depending upon the weight of the material in the bag B, and first and second base members 29, 31 are moved by first, second, third and fourth leg members 17, 19, 21, 23 towards a substantially horizontal position, as illustrated, for example, by the position of first base member 29 shown in FIG. 5, which would appear the same for second base member 31. In other words, it can be stated that base members 29 and 31 are respectively slightly bent upwardly from the ends 35, 37 and 59, 73 towards the respective mid-portions 33, 47 thereof when bag holder 11 is in said bag removed condition, and when bag holder 11 is in said bag holding condition the base members 29, 31 are moved to or towards a substantially straight or substantially horizontal condition, so that the bottom of base 13 is substantially flat when in use. Also, it should be pointed out that the angle between first, second, third, and fourth leg members 17, 19, 21, 23 and the respective portions 39, 79, 41, 81 of base members 29, 31 to which first, second, third, and fourth leg members 17, 19, 21, 23 are fixedly attached is substantially a ninety degree angle when the bag holder is in said bag removed condition and remains substantially a ninety degree angle when the bag holder is moved to said bag holding condition so that the combination of said resilient base members 29, 31 and resilient first, second, third, and fourth leg members 17, 19, 21, 23 provide a spring effect and bias the mouth of the bag towards an open position holding the bag taut and secure, even with different sizes of bags. If it were not for the slightly bent condition of base members 29 and 31 when in the bag removed condition of holder 11, then base members 29, 31 would bow downwardly when in the bag holding condition, which would render the bag holder 11 unstable and cause rocking of the bag holder 11.

The manner of using bag holder 11 is very simple. One first wraps a small portion of the mouth of a plastic bag, such as bag B, over one lip portion 25 or 27 and stretches the opposite side of the mouth over the other lip portion. This causes the two sides 49, 63 to be compressed inward, and to hold the bag taut.

Bag holder 11 can be moved easily from place to place while in use. When the bag is full, it is easy to remove the contents from bag holder 11 and replace with an empty bag.

From the foregoing description of the construction and operation of bag holder 11, it will be understood that the present invention provides a simple, yet reliable device that can be used by practically anyone. The bag holder is durable and does not have multiple parts to break or wear out. Yet the device is economical. The variety of sizes in which it can be constructed allows it to be a practical appliance in any home or business.

The bag holder can be made different dimensions to accommodate many bag sizes. It can be made small enough to file under a kitchen cabinet for waste, or large enough to hold a 55 gallon industrial size bag for commercial use. Also, for any given designed dimensions of a particular bag holder 11 for a particular use there is a wide range of sizes of bags that can be accommodated. For example, if bag holder 11 is designed for yard use to collect leaves, debris, etc., the bag holder will accommodate any size of leaf bag, e.g., 20, 30, 40 gallons, etc., and because of the unique construction of bag holder 11, particularly the combination and action of the leg members 17, 19, 21, and 23 with the respective upwardly angled portions 39, 79, 41, and 81 fixedly connected thereto, the advantages heretofore mentioned in connection with the improved bag holder 11 of the present invention are possible. Thus, with the different sizes of leaf bags, for example, one designed size of bag holder 11, which is to be used with leaf bags of all sizes, is very effective in its ability to securely hold the various sizes of leaf bags, is stable, does not rock when placed on a supporting surface, is easily moved while being utilized, and provides a strong spring action to spread the mouth of the bags regardless of size.

Also, it should be pointed out that the present invention provides a simple, yet reliable device that can be used by practically anyone. The bag holder is durable and does not have multiple parts to break or wear out. Yet the device is economical. The variety of sizes in which it can be constructed allows it to be a practical appliance in any home or business.

Although the present invention has been described and illustrated with respect to a preferred embodiment and a preferred use therefor, it is not to be so limited since modifications and changes can be made therein which are within the full intended scope of the invention.

I claim:

1. A bag holder placeable in a bag holding condition in which a bag is being held by the bag holder and a bag removed condition in which no bag is being held by the bag holder, said bag holder comprising:

(a) a base including a resilient first base member having opposite ends and a resilient second base member having opposite ends, said first and second base members being spaced apart in substantially parallel relationship;

(b) a crossbar member joining said first base member and said second base member midway and perpendicular between said first base member and said second base member;

(c) four resilient legs fixedly attached to said base and upwardly extending therefrom, two of said legs being respectively attached to one of the ends of said first base member and to one of the ends of said second base member to provide a first side of the bag holder, and the other two of said legs being respectively attached to the other of the ends of said first base member and to the other of the ends of said second base member to provide a second side of the bag holder;

(d) said first base member and said second base member being slightly bent upward at the respective junctures of said crossbar member and said first base member and said second base member;

wherein when said bag holder is in the bag removed condition said first and second sides of said bag holder diverge upwardly and outwardly away from one another with the upper ends of said first and second sides being spaced apart wider than the mouth of the bag to be held by the bag holder whereby when said bag holder is placed in said bag holding condition with the bag on said bag holder said first and second sides of said bag holder are held inwardly towards one another in a substantially vertical position by the bag and said first and second base members are moved by said first, second, third and fourth leg members towards a straightened horizontal position.

2. The bag holder of claim 1 in which said first side of the bag holder includes a first lip portion fixedly attached to the upper ends of said leg members on said first side of the bag holder and in which said second side of the bag holder includes a second lip portion fixedly attached to the upper ends of said leg members on said second side of the bag holder.

3. A bag holder for supporting flexible bags in an open condition at the mouth, said bag holder comprising:

(a) a base including i. a first resilient elongated base member, ii. a second resilient elongated base member, iii. said first base member and said second base member being spaced apart in substantially parallel relationship and each including: a mid-portion, a first end and a second end, a first portion extending between said first end and said mid-portion, and a second portion extending between said second end and said mid-portion, (b) a single crossbar member extending between said first base member and said second base member, said crossbar member having a first end and an opposite second end, said bar member being fixedly attached at the first end thereof to said first base member adjacent said mid-portion of said first base member and being fixedly attached at the second end thereof to said second base member adjacent said mid-portion of said second base member;

(c) a first side of the bag holder including:

i. a first elongated resilient leg member having an upper end and a lower end, and ii. a second elongated resilient leg member having an upper end and a lower end, said first elongated member and said second elongated member being spaced laterally apart from one another and being respectively fixedly attached adjacent the lower ends thereof to said first ends of said first base member and said second base member, and (c) a second side of the bag holder including:

i. a third resilient elongated leg member having an upper end and a lower end, and ii. a fourth resilient elongated leg member having an upper end and a lower end, said third elongated member and said fourth elongated member being spaced laterally apart from one another and being respectively fixedly attached adjacent the lower ends thereof to said second ends of said first base member and said second base member, wherein said bag holder being placeable in a bag holding condition in which a bag is held by the bag holder and a bag removed condition in which there is no bag being held by the bag holder, when said bag holder is in the bag removed condition said first and second sides of said bag holder diverge upwardly and outwardly away from one another with the upper ends of said first and second sides being spaced apart wider than the mouth of the bag to be held by said bag holder and said first and second portions of said first and second base members respectively extend upwardly at an angle from said first and second ends of said first and second base members towards the respective said mid-portions of said first and second base members whereby when said bag holder is placed in said bag holding condition with the bag on said bag holder said first and second sides of said bag holder are held inwardly towards one another in a substantially vertical position by the bag and said first and second base members are moved by said first, second, third and fourth leg members towards a horizontal position.

4. The bag holder of claim 3 in which said first side of said bag holder includes a first lip portion having a first end and an opposite second end, said first lip portion being fixedly attached at the first and second ends thereof respectively to said upper ends of said first leg member and said second leg member and extending outwardly therefrom, and in which said second side of the bag holder includes a second lip portion having a first end and an opposite second end, said second lip portion being fixedly attached at the first and second ends thereof respectively to said upper ends of said third leg member and said fourth leg member and extending outwardly therefrom.

5. The bag holder of claim 3 in which the angle between said first, second, third, and fourth leg members and the respective portions of said first and second base members to which said first, second, third, and fourth leg members are attached is substantially a ninety degree angle when the bag holder is in said bag removed condition and remains substantially a ninety degree angle when the bag holder is placed in said bag holding condition so that the combination of said resilient base members and said resilient first, second, third, and fourth leg members provide a spring effect and bias the mouth of the bag towards an open position holding the bag taut and secure.

* * * * *